US010987727B2

(12) United States Patent
Propheter-Hinckley

(10) Patent No.: US 10,987,727 B2
(45) Date of Patent: Apr. 27, 2021

(54) INVESTMENT CASTING CORE SYSTEM

(71) Applicant: United Technologies Corporation, Farmington, CT (US)

(72) Inventor: Tracy A. Propheter-Hinckley, Rocky Hill, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 134 days.

(21) Appl. No.: 16/210,113

(22) Filed: Dec. 5, 2018

(65) Prior Publication Data

US 2020/0180015 A1 Jun. 11, 2020

(51) Int. Cl.

| | |
|---|---|
| ***B22C 9/10*** | (2006.01) |
| ***B22C 21/14*** | (2006.01) |
| ***B22C 7/02*** | (2006.01) |
| ***F01D 5/14*** | (2006.01) |
| ***F01D 5/18*** | (2006.01) |
| ***F01D 25/14*** | (2006.01) |

(52) U.S. Cl.

CPC ..... *B22C 9/10* (2013.01); *B22C 7/02* (2013.01); *B22C 21/14* (2013.01); *F01D 5/147* (2013.01); *F01D 5/18* (2013.01); *F01D 25/14* (2013.01); *F05D 2230/211* (2013.01); *F05D 2260/20* (2013.01)

(58) Field of Classification Search

CPC ..... B22C 9/10; B22C 9/103; B22C 9/108; B22C 9/22; B22C 21/14

See application file for complete search history.

(56) References Cited

U.S. PATENT DOCUMENTS

| | | | | |
|---|---|---|---|---|
| 5,853,044 | A * | 12/1998 | Wheaton | B22C 7/02 164/516 |
| 5,950,705 | A | 9/1999 | Huang | |
| 6,186,217 | B1 * | 2/2001 | Sikkenga | B22C 7/026 164/137 |
| 8,302,668 | B1 * | 11/2012 | Bullied | B22C 9/103 164/516 |
| 8,336,606 | B2 | 12/2012 | Piggush | |
| 2007/0025851 | A1 | 2/2007 | Guerche et al. | |
| 2013/0333855 | A1 | 12/2013 | Merrill et al. | |

FOREIGN PATENT DOCUMENTS

| | | |
|---|---|---|
| EP | 2777841 | 9/2014 |
| EP | 2892671 | 7/2015 |
| WO | WO 2017149229 | 9/2017 |

OTHER PUBLICATIONS

International Search Report and Written Opinion for International Application No. PCT/US2019/060701 completed Mar. 13, 2020.

* cited by examiner

*Primary Examiner* — Kevin E Yoon

(74) *Attorney, Agent, or Firm* — Carlson, Gaskey & Olds, P.C.

(57) ABSTRACT

An investment casting core system includes first and second investment casting cores. The first investment casting core has a pin and the second investment casting core has a hole and an access slot that opens to the hole. The pin is disposed in the hole such as to space the first investment casting core in a fixed position relative to the second investment casting core. A bonding agent is disposed in the access slot and around the pin in the hole.

11 Claims, 5 Drawing Sheets

INVESTMENT CASTING CORE SYSTEM

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

SUMMARY

An investment casting core system according to an example of the present disclosure includes first and second investment casting cores. The first investment casting core has a pin and the second investment casting core has a hole and an access slot that opens to the hole. The pin is disposed in the hole such as to space the first investment casting core in a fixed position relative to the second investment casting core. A bonding agent is disposed in the access slot and around the pin in the hole.

In a further embodiment of any of the foregoing embodiments, the access slot includes a ramped side.

In a further embodiment of any of the foregoing embodiments, the ramped side defines a ramp axis, and the ramp axis is non-intersecting with the first investment casting core.

In a further embodiment of any of the foregoing embodiments, the pin defines a central pin axis, and the ramp axis is obliquely angled to the pin axis.

In a further embodiment of any of the foregoing embodiments, the access slot includes a first open side extending from the pin, a second open side extending along the pin, and a ramped side joining the first open side and the second open side.

In a further embodiment of any of the foregoing embodiments, the access slot extends beyond an edge of the first investment casting core.

In a further embodiment of any of the foregoing embodiments, the first investment casting core is shaped to form a cooling passage network embedded in a wall of a gas turbine engine article. The first investment casting core represents a negative of the cooling passage network in which solid structures of the first investment core produce void structures in the cooling passage network and void structures of the first investment core produce solid structures in the cooling passages network. The first investment core has the negative of the following structures of the cooling passage network: an inlet orifice formed by the pin, a sub-passage region including an array of pedestals, and an exit region having an array of flow guides.

A method of fabricating an investment casting core system according to an example of the present disclosure includes providing first and second investment casting cores. The first investment casting core has a pin and the second investment casting core has a hole and an access slot that opens to the hole. The pin is disposed in the hole such as to space the first investment casting core in a fixed position relative to the second investment casting core. An injector is inserted into the access slot. A bonding agent is dispensed from the injector into the access slot and around the pin in the hole.

In a further embodiment of any of the foregoing embodiments, the inserting of the injector is clear of contact with the first investment casting core.

A further embodiment of any of the foregoing embodiments includes casting a material around the first and second investment casting cores, followed by removing the first and second investment casting cores and the bonding agent. The bonding agent leaves a witness mark on a surface of the material.

In a further embodiment of any of the foregoing embodiments, the access slot includes a ramped side.

In a further embodiment of any of the foregoing embodiments, the ramped side defines a ramp axis, and the ramp axis is non-intersecting with the first investment casting core.

In a further embodiment of any of the foregoing embodiments, the pin defines a central pin axis, and the ramp axis is obliquely angled to the pin axis.

In a further embodiment of any of the foregoing embodiments, the access slot includes a first open side extending from the pin, a second open side extending along the pin, and a ramped side joining the first open side and the second open side.

In a further embodiment of any of the foregoing embodiments, the access slot extends beyond an edge of the first investment casting core.

In a further embodiment of any of the foregoing embodiments, the first investment casting core is shaped to form a cooling passage network embedded in a wall of a gas turbine engine article. The first investment casting core represents a negative of the cooling passage network in which solid structures of the first investment core produce void structures in the cooling passage network and void structures of the first investment core produce solid structures in the cooling passages network. The first investment core has the negative of the following structures of the cooling passage network: an inlet orifice formed by the pin, a sub-passage region including an array of pedestals, and an exit region having an array of flow guides.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
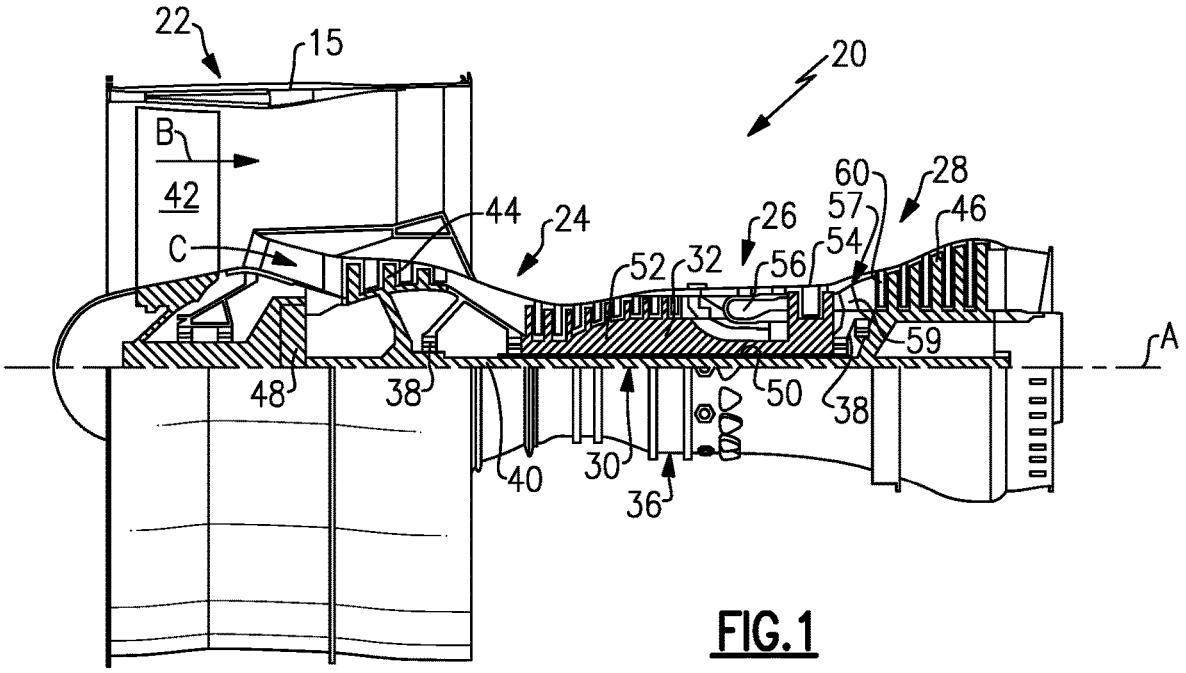
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Figure 2:
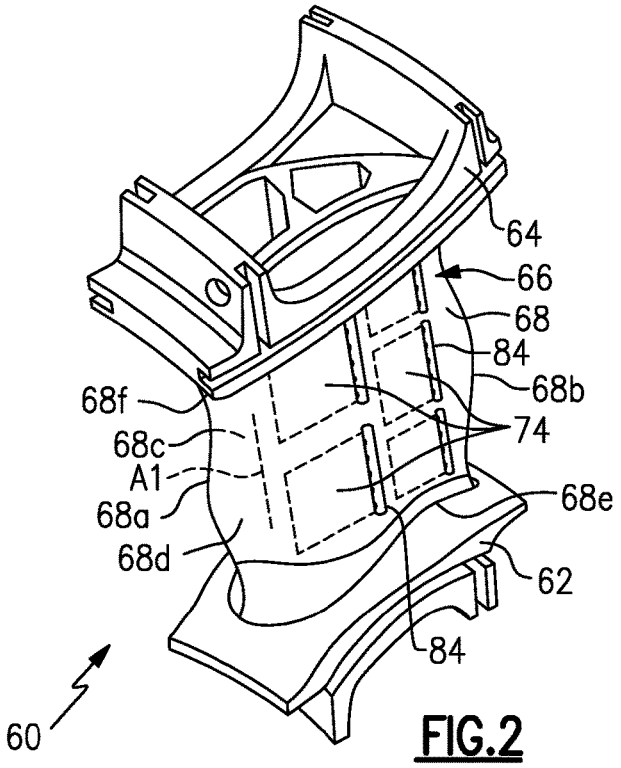
FIG. 2 illustrates an airfoil of the engine of FIG. 1.

FIG. 2 illustrates a representative example of a gas turbine engine article, namely a turbine airfoil 60 used in the turbine engine 20 (see also FIG. 1). As shown, the turbine airfoil 60 is a turbine vane; however, it is to be understood that, although the examples herein may be described with reference to the turbine vane, this disclosure is also applicable to turbine blades, blade outer air seals, combustor panels, or other articles that are fabricated by investment casting using multiple investment casting cores. The turbine airfoil 60 is also shown in a cross-sectioned view in FIG. 3.

Figure 3:
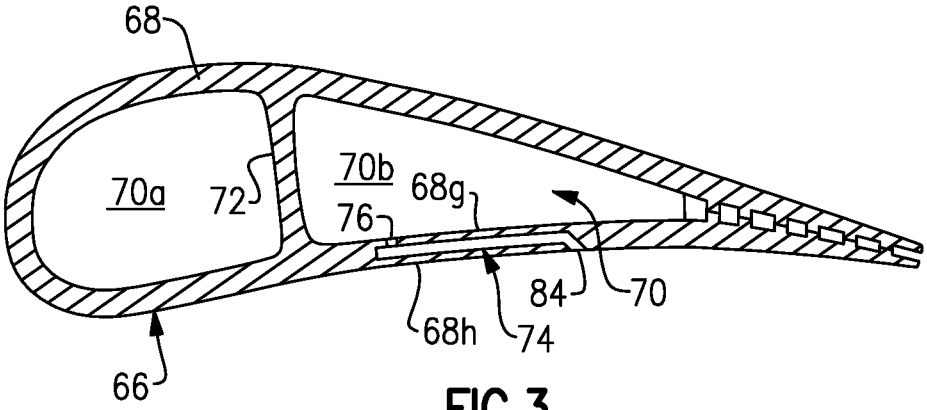
FIG. 3 illustrates a sectioned view of the airfoil of FIG. 2.

Referring to FIGS. 2 and 3, the turbine airfoil 60 includes an inner or first platform 62, an outer or second platform 64, and an airfoil section 66 that spans in a longitudinal direction A1 (which is also a radial direction relative to the engine central axis A) between the first and second platforms 62/64. Terms such as "radially," "axially," or variations thereof are used herein to designate directionality with respect to the engine central axis A.

The airfoil section 66 includes an airfoil outer wall 68 that delimits the profile of the airfoil section 66. The outer wall 68 defines a leading end 68*a*, a trailing end 68*b*, and first and second sides 68*c*/68*d* that join the leading and trailing ends 68*a*/68*b*. The first and second sides 68*c*/68*d* span in the longitudinal direction between first and second ends 68*e*/68*f*. The first and second ends 68*e*/68*f* are attached, respectively, to the first and second platforms 62/64. In this example, the first side 68*c* is a suction side and the second side 68*d* is a pressure side. As shown in a sectioned view through the airfoil section 66 in FIG. 3, the outer wall 68 circumscribes an internal core cavity 70.

The airfoil section 66 further includes a rib 72 in the internal core cavity 70. The rib 72 partitions the internal core cavity 70, dividing the cavity 70 into a forward cavity 70*a* and an aft cavity 70*b*. In this example, the rib 72 extends from the first side 68*c* to the second side 68*d* and is solid and free of any orifices. The rib 72 thereby fluidly isolates the forward and aft cavities 70*a*/70*b* of the internal core cavity 70.

There is at least one cooling passage network 74 embedded in the airfoil outer wall 68 between inner and outer portions 68*g*/68*h* of the airfoil wall 68. For example, as shown (FIG. 3) one or more of the cooling passage networks 74 is embedded in the second side 68*d* of the outer wall 68, although one or more networks 74 could additionally or alternatively be embedded in the first side 68*c*. The cooling passage networks 74 may also be referred to as minicores or minicore passages. A "minicore" or "minicore passage" is a reference to the small investment casting core that is typically used to make such an embedded passage, as opposed to a main core that is used to form a main or central core cavity in an airfoil.

Figure 4:
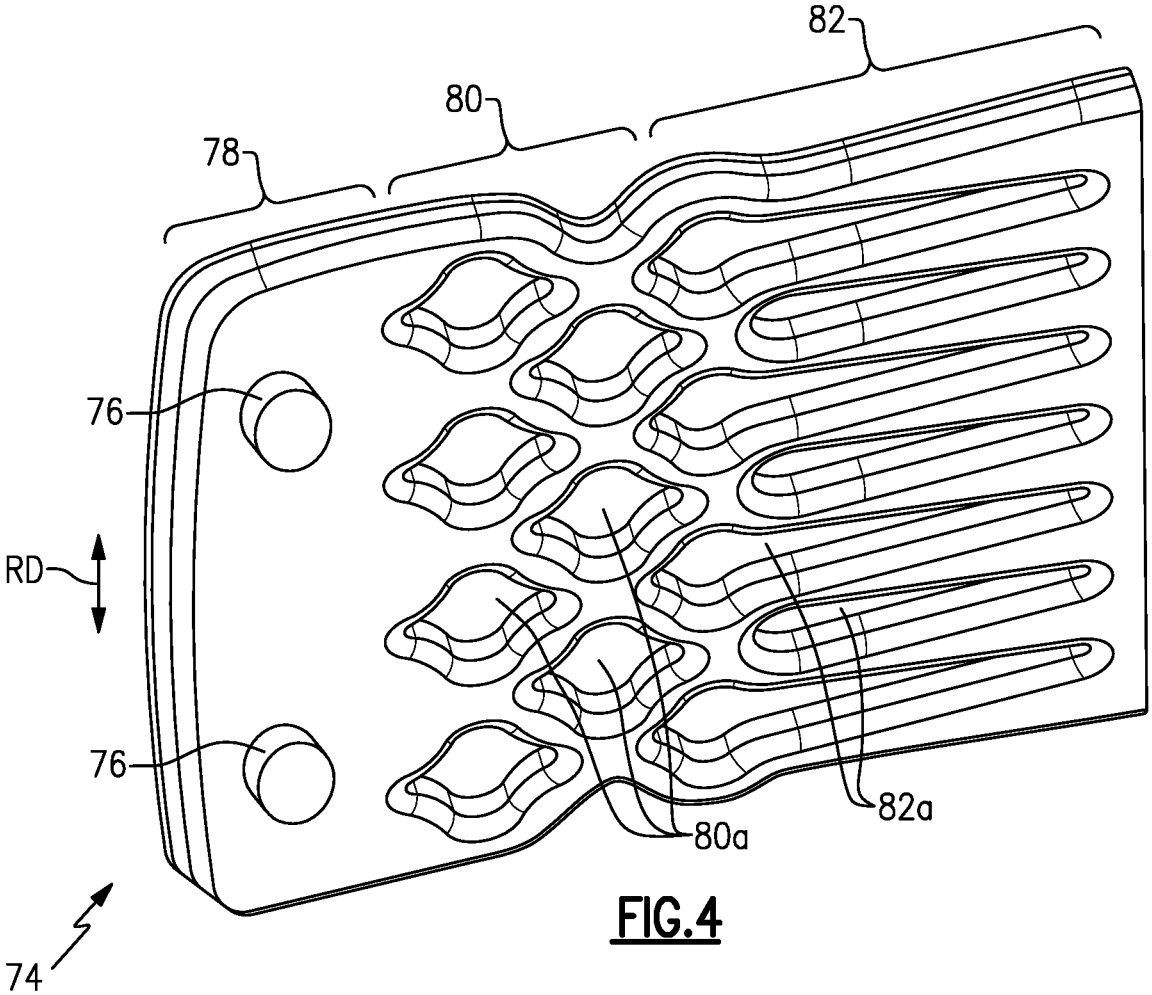
FIG. 4 illustrates an investment casting core for forming a cooling passage network in the airfoil of FIG. 2.
Figure 5:
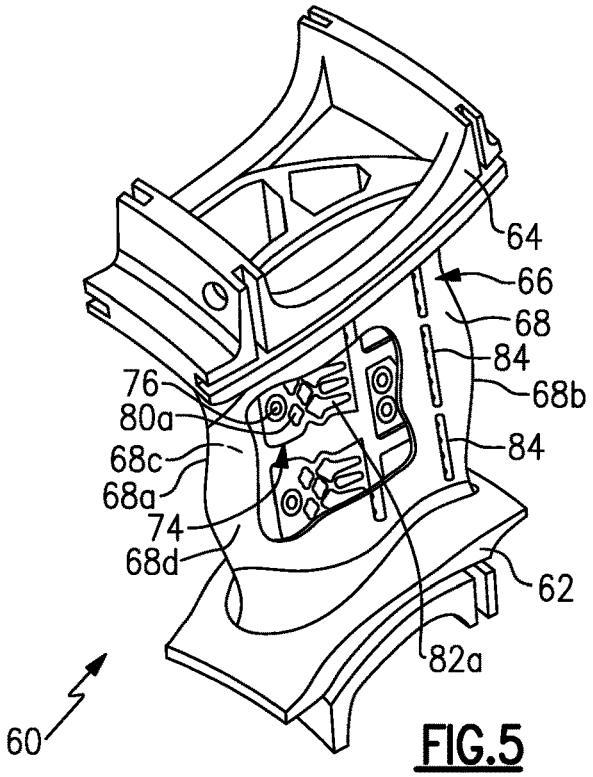
FIG. 5 illustrates a partial cutaway view of the airfoil of FIG. 2.

FIG. 4 shows an "inverse" or negative view of a representative one of the cooling passage networks 74, which are also partially shown in a cutaway view of the airfoil 60 in FIG. 5. The inverse view is also representative of an investment casting core that may be used in an investment casting process to form the network 74 in the airfoil 60. Most typically, the investment casting core is injection molded from a material that contains ceramic or metal alloy. The investment casting core is shaped to form the cooling passage network 74. In the inverse view, solid structures of the investment casting core produce void structures in the cooling passage network 74 and void structures of the investment casting core produce solid structures in the cooling passage network 74. Thus, the investment casting core has the negative of the structural features of the cooling passage network 74. It is to be understood that although the inverse views presented herein may be used to describe features of the network 74, each negative view also represents an investment casting core and a corresponding cavity in a molding tool that is operable to mold the investment core.

The cooling passage network 74 includes at least one inlet orifice 76 through the inner portion 68*g* of the airfoil outer wall 68 (FIG. 3) to receive cooling air from the internal core cavity 70. The inlet orifice 76 may be round and/or rectangular/racetrack and sized to achieve proper flow characteristics in the network 74. Most typically, the network 74 will include two inlet orifices 76. A single, exclusive inlet orifice 76 is also contemplated, as well as more than two inlet orifices 76, although fabrication may be challenging.

The inlet orifices 76 open into a radially-elongated manifold region 78 (see FIG. 4, radial direction RD), which serves to distribute the cooling air to a downstream sub-passage region 80, which then leads into an exit region 82 that feeds into one or more outlet orifices 84 (FIG. 3) through the inner portion 68*g* of the airfoil wall 68. In this example, the exit region 82 includes an array of flow guides 82*a*. For instance, the flow guides 82*a* have a teardrop shape and facilitate straightening and guiding flow into the one or more outlet orifices 84. In general, the inlet orifices 76 of the network 74 are located forward of the one or more outlet orifices 84.

In this example, the sub-passage region 80 includes an array of pedestals 80*a*. The pedestals 80*a* are arranged in radial rows that extend in the radial direction RD in the airfoil 60, which is perpendicular to the engine axis A. The rows are radially offset from each other and the pedestals 80*a* of the rows are interleaved so as to define sub-passages there between. The size and shape of the pedestals 80*a* and subsequent sub-passages between the pedestals 80*a* may be determined depending on the desired flow/pressure loss across the network 74 and heat transfer by the cooling air. The pedestals 80*a* as shown have a lobed-diamond cross-sectional geometry. It is to be understood, however, that the pedestals 80*a* may alternatively be, but are not limit to, diamond or other polygonal shape, round, oval, or elliptical.

During operation of the engine 20, cooling air, such as bleed air from the compressor section 24, is fed into the internal core cavity 70. The cooling air from the core cavity 70 flows into the cooling passage network 74 to cool the outer wall 68. The cooling air enters the cooling passage network 74 through the one or more inlet orifices 76 into the manifold region 78. The cooling air then turns within the manifold region 78 and flows into and through the sub-passage region 80, through the exit region 82, and out the one or more outlet orifices 84 to provide surface film cooling on the exterior surface of the airfoil section 66.

The airfoil 60 is fabricated from a metal alloy in an investment casting process. In such a process, investment casting cores are used to form the network or networks 74 and core sub-cavities 70*a*/70*b*, as well as any other internal passage in the particular design of the article being fabricated. Most typically, the cores are separately formed pieces that are then secured together in the desired arrangement. As will be appreciated, these cores must be precisely fixed relative to one another in order to properly form the article. In this regard, a bonding agent may be used to hold the cores together. The bonded cores are then placed in an investment casting mold shell and then the molten metal alloy is poured into the mold around the cores to form the end article. A challenge, particularly with the network or networks 74, is that the cores may be positioned close to one another with only a small gap there between. For instance, the gap (e.g., the gap forming the inner portion 68*g* of the airfoil wall 68) between the core forming the network 74 and the core forming the sub-cavity 70*b* may have a thickness of less than one millimeter. Such a thin gap precludes ready access to the space between the cores to precisely introduce the bonding agent to bond the cores together, especially without damaging the cores, disturbing the positioning of the cores, or introducing too much or too little of bonding agent.

Figure 6:
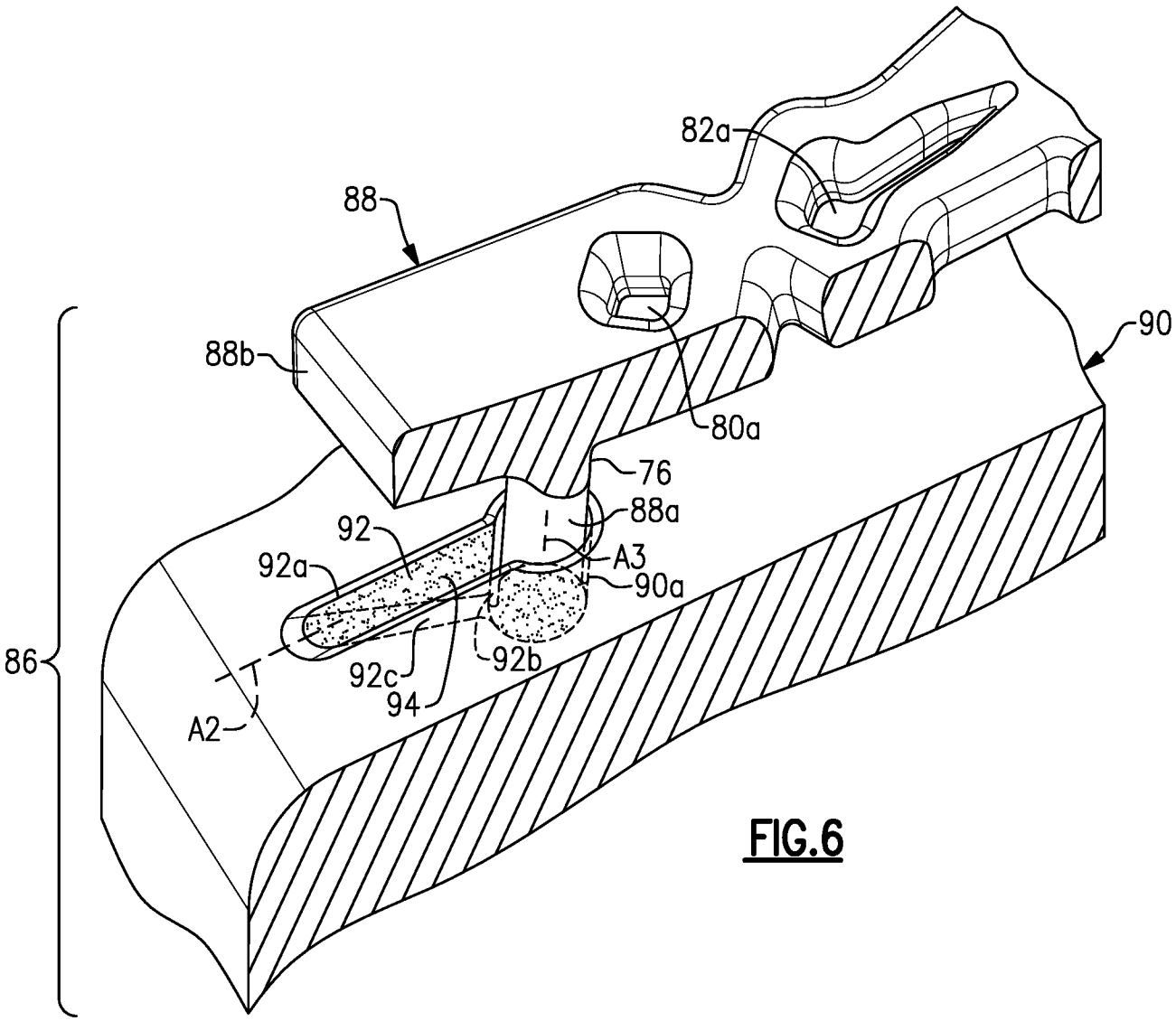
FIG. 6 illustrates an investment casting core system.

In this regard, referring to FIG. 6, there is an investment casting core system 86 that facilitates precise bonding of investment casting cores. In the examples shown, the system 86 includes first and second investment casting cores 88/90. For instance, the first investment casting core 88 (shown in part) is the core of FIG. 4 and the second investment casting core 90 is a core shaped to form the sub-cavity 70*b*. The space in between the cores 88/90 will, upon casting, become the inner portion 68*g* of the airfoil wall 68. It is to be appreciated that, although the examples herein may be described with reference to the cores for forming the network 74 and sub-cavity 70*b*, the examples are also applicable to other components that are fabricated by investment casting using multiple closely-situated cores.

In the system 86 the first investment casting core 88 includes a pin 88*a*. In this example, the pin 88*a* corresponds to the inlet orifice 76 of the network 74. The second investment casting core 90 defines a hole 90*a* and an access slot 92 that opens to the hole 90*a*. The pin 88*a* is disposed in the hole 90*a* such as to space the first investment casting core 88 in a fixed position relative to the second investment casting core 90. As an example, the pin 88*a* may bottom-out in the hole 90*a*, leaving a spacing of less than one millimeter between the cores 88/90. A bonding agent 94 is disposed in the access slot 92 and around the pin 88*a* in the hole 90*a*.

The access slot 92 provides access for introducing the bonding agent 94. The access slot 92 includes a first open side 92*a* that extends from the pin 88*a*, a second open side 92*b* that extends along the pin 88*a*, and a ramped side 92*c* that joins the first open side 92*a* and the second open side 92*b*.

A portion or a substantial portion of the access slot 92 may be between the cores 88/90. However, at least a portion of the access slot 92 may extend beyond an edge 88*b* of the core 88, to enable ready access to the access slot 92. The ramped side 92*c* defines a ramp axis A2, which also facilitates providing access to the access slot 92 and pin 88*a*. For example, the ramp axis A2 is non-intersecting with the core 88, thereby providing a clear line into the access slot 92 to the pin 88*a* from outside of the region between the cores 88/90. In one example, the pin 88*a* defines a central pin axis A3, and the ramp axis A2 is obliquely angled to the pin axis A3. For instance, the angle is from 30° to 60°. If the angle is too shallow, the length of the access slot 92 would be long and may increase the risk of impacting the shape of the casting to a degree that significantly influences function. If the angle is too steep, the ramp axis A2 will either intersect the core 88 or be close to the edge 88*b*, thereby increasing the risk of interference with the edge 88*b* and damaging the core 88 during introduction of the bonding agent 94.

Figure 7A:
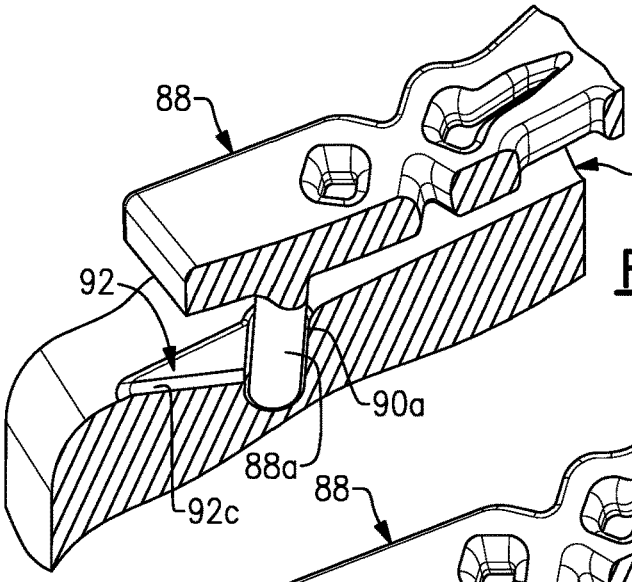
FIGS. 7A, 7B, 7C, and 7D illustrate progressions in a method of fabricating an investment casting core system.

FIGS. 7A, 7B, 7C, and 7D illustrates progressions of an example method of fabricating the investment casting core system 86. Initially, the method involves providing the cores 88/90. The cores 88/90 may be provided as pre-fabricated pieces or be provided by injection molding the cores 88/90 from a material that contains ceramic or metal alloy. As shown in FIG. 7A, the cores 88/90 may initially be dry-fitted together such that the pin 88*a* is disposed in the hole 90*a*.

Figure 7B:
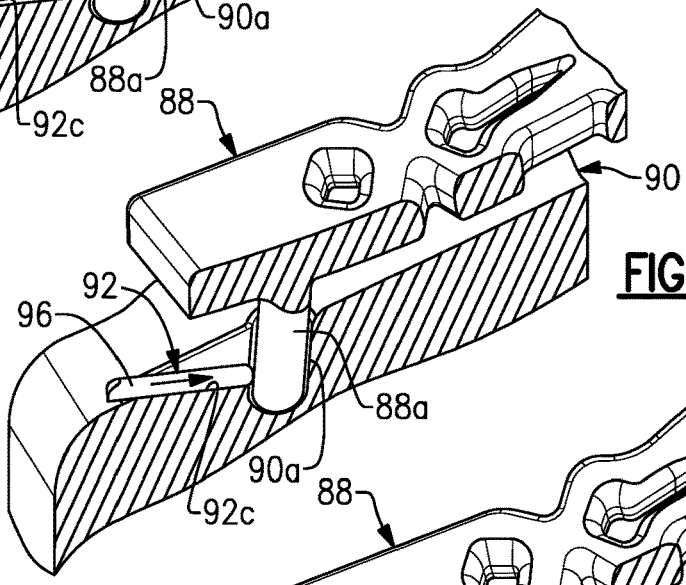

As shown in FIG. 7B, an injector 96 is then inserted into the access slot 92. In general, the insertion direction of the injector 96 is parallel or substantially parallel to the ramp axis A2. In one example, the injector 96 may contact the ramp side 92*c* during insertion and the ramp side 92*c* may facilitate guiding the injector 96 down the access slot 92 toward the pin 88*a*. The access slot 92 may be narrow in width but wider than the size of the injector 96.

Figure 7C:
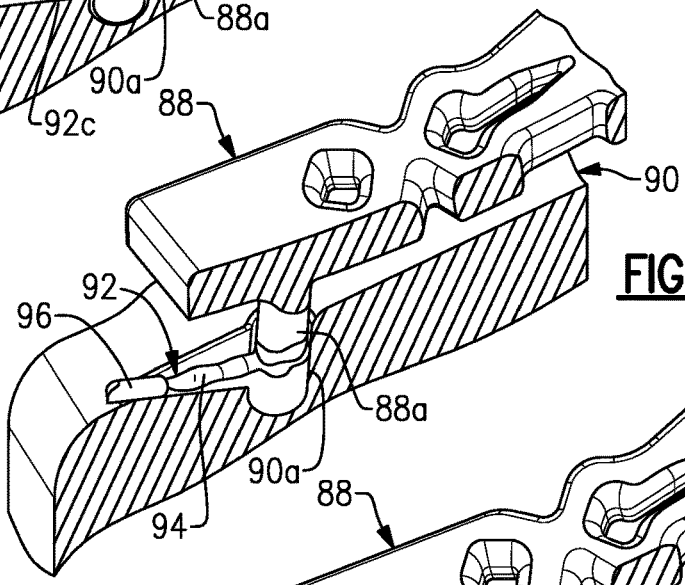
Figure 7D:
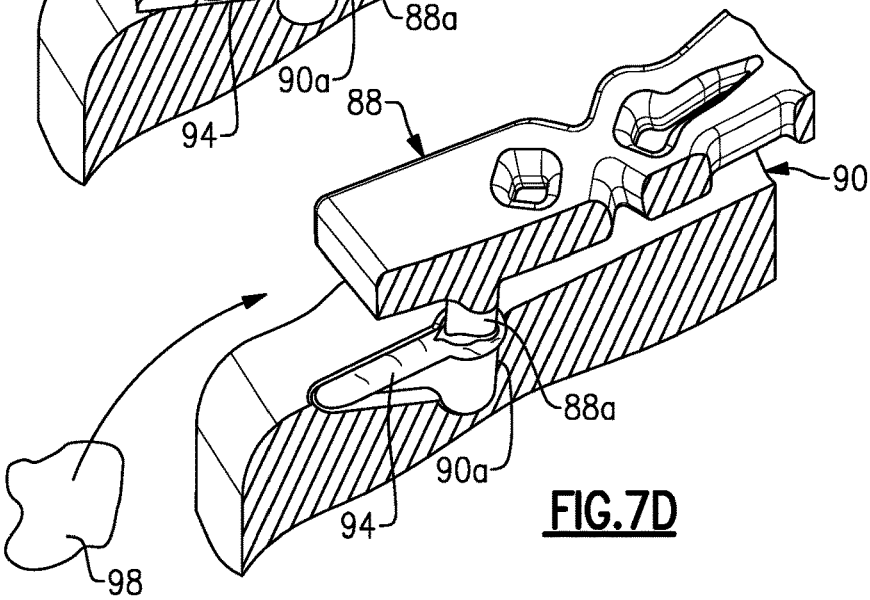

As an example, the injector 96 is a dispenser that has a needle or tube through which the bonding agent 94 can be dispensed. For instance, the bonding agent 94 may initially be a ceramic suspension, such as a colloidal suspension. As depicted in FIG. 7C, the bonding agent 94 is dispensed from the injector 96 into the access slot 92 and around the pin 88*a* in the hole 90*a*. For instance, the bonding agent 94 may initially be dispensed at the pin 88*a* such that the bonding agent 94 flows and fills in the space around the pin 88*a* in the hole 90*a*. As the region around the pin 88*a* in the hole 90*a* fills, the injector 96 may be gradually retracted so that the bonding agent 94 then begins to fill the access slot 92 until the access slot 92 is filled or substantially filled, as shown in FIG. 7D. For instance, the bonding agent 94 may fill the access slot 94 such that the exposed surface of the bonding agent 94 is flush with the adjacent surfaces of the core 90. After dispensing the bonding agent 94, the bonding agent may be consolidated via thermal processing. As an example, the bonding agent 94 may be consolidated in conjunction with firing of a ceramic investment casting shell. For instance, the shell envelops a wax investment and the cores 88/90 to form the outer walls of an investment mold. Once consolidated, the bonding agent 94 secures the cores 88/90 together via the pin 88*a* and hole 90*a*.

The configuration of the access slot 92 described above enables ready access of the injector 96 to dispense the bonding agent 94 around the pin 88*a*. For instance, the access slot 92 permits ready access to the pin 88*a* from outside of the region between the cores 88/90, and at an angle along the ramped surface 92*c* which ensures that the injector 96 is substantially clear of the edge 88*b* of the core 88.

Figure 8:
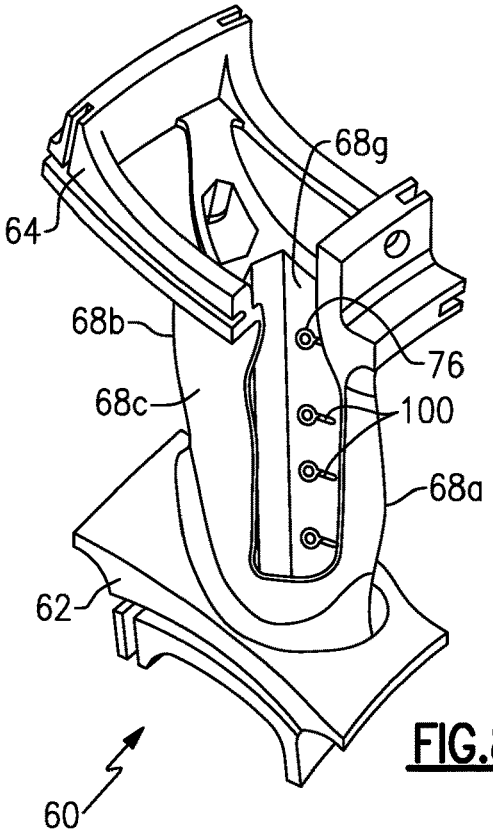
FIG. 8 illustrates a partial cutaway view of an airfoil produced by the method of FIGS. 7A, 7B, 7C, and 7D.

Once the cores 88/90 are secured together, the airfoil 60 can be investment cast. As an example, as represented in FIG. 7D, a material 98, such as a molten metal alloy, is cast around the cores 88/90 to form the airfoil 60. The cores 88/90 and bonding agent 94 are then removed, leaving the airfoil as shown in FIG. 8 and also described above. For instance, the cores 88/98 and bonding agent 94 may be removed by leaching.

As depicted in FIG. 8, there are witness marks 100 near the inlet orifices 76. The witness marks 100 are vestiges of the access slots 92 and bonding agent 94. During the investment casting process, the bonding agent 94 and access slot 92 create surface discontinuities in the cast metal alloy. Most typically, the surface discontinuities do not rise to a level that affects the form or function of the airfoil 60.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. An investment casting core system comprising:

first and second investment casting cores, the first investment casting core having a pin and the second investment casting core having a hole and an access slot that opens to the hole, the access slot including a ramped side defining a ramp axis that is non-intersecting with the first investment casting core, the pin being disposed in the hole such as to space the first investment casting core in a fixed position relative to the second investment casting core, the pin defining a central pin axis, the ramp axis is obliquely angled to the pin axis, and a bonding agent disposed in the access slot and around the pin in the hole.

2. The system as recited in claim 1, wherein the access slot includes a first open side extending from the pin, a second open side extending along the pin, and the ramped side joining the first open side and the second open side.

3. The system as recited in claim 1, wherein the access slot extends beyond an edge of the first investment casting core.

4. The system as recited in claim 1, wherein the first investment casting core is shaped to form a cooling passage network embedded in a wall of a gas turbine engine article, the first investment casting core representing a negative of the cooling passage network in which solid structures of the first investment core produce void structures in the cooling passage network and void structures of the first investment core produce solid structures in the cooling passages network, the first investment core having the negative of the following structures of the cooling passage network: an inlet orifice formed by the pin, a sub-passage region including an array of pedestals, and an exit region having an array of flow guides.

5. The system as recited in claim 1, wherein the ramp axis is obliquely angled to the pin axis at an angle from 30° to 60°.

6. A method of fabricating an investment casting core system, the method comprising:

providing first and second investment casting cores, the first investment casting core has a pin and the second investment casting core has a hole and an access slot that opens to the hole, the access slot includes a ramped side that defines a ramp axis that is non-intersecting with the first investment casting core, the pin is disposed in the hole such as to space the first investment casting core in a fixed position relative to the second investment casting core, the pin defines a central pin axis, and the ramp axis is obliquely angled to the pin axis;

inserting an injector into the access slot; and dispensing a bonding agent from the injector into the access slot and around the pin in the hole.

7. The method as recited in claim 6, wherein the inserting of the injector is clear of contact with the first investment casting core.

8. The method as recited in claim 6, including casting a material around the first and second investment casting cores, followed by removing the first and second investment casting cores and the bonding agent, the bonding agent leaving a witness mark on a surface of the material.

9. The method as recited in claim 6, wherein the access slot includes a first open side extending from the pin, a second open side extending along the pin, and the ramped side joining the first open side and the second open side.

10. The method as recited in claim 6, wherein the access slot extends beyond an edge of the first investment casting core.

11. The method as recited in claim 6, wherein the first investment casting core is shaped to form a cooling passage network embedded in a wall of a gas turbine engine article, the first investment casting core representing a negative of the cooling passage network in which solid structures of the first investment core produce void structures in the cooling passage network and void structures of the first investment core produce solid structures in the cooling passages network, the first investment core having the negative of the following structures of the cooling passage network: an inlet orifice formed by the pin, a sub-passage region including an array of pedestals, and an exit region having an array of flow guides.

* * * * *